US006796735B2

(12) United States Patent
Lin

(10) Patent No.: US 6,796,735 B2
(45) Date of Patent: Sep. 28, 2004

(54) KEYBOARD WITH PAPER HOLDER STRUCTURE

(76) Inventor: Kenny Lin, 9F-1, No. 52, Sec. 3, Anhe Rd., Shindian City, Taipei (TW)

( * ) Notice: Subject to any disclaimer, the term of this patent is extended or adjusted under 35 U.S.C. 154(b) by 0 days.

(21) Appl. No.: 10/338,346

(22) Filed: Jan. 8, 2003

(65) Prior Publication Data

US 2004/0131411 A1 Jul. 8, 2004

(51) Int. Cl.[7] ..... B41J 5/08
(52) U.S. Cl. ..... 400/472; 248/442.2; 248/460
(58) Field of Search ..... 400/472; 248/442.2, 248/441.1, 460

(56) References Cited

U.S. PATENT DOCUMENTS 4,546,947 A * 10/1985 Gesten ..... 248/442.2
4,635,893 A * 1/1987 Nelson ..... 248/558
4,808,017 A * 2/1989 Sherman et al. ..... 400/83
5,136,787 A * 8/1992 Phills ..... 33/483
5,505,421 A * 4/1996 Marthaler ..... 248/442.2
5,771,814 A * 6/1998 Clausen ..... 108/93
5,786,861 A * 7/1998 Parker ..... 248/442.2
5,826,840 A * 10/1998 Yun ..... 248/118
5,845,889 A * 12/1998 Suzuki ..... 248/451
6,042,075 A * 3/2000 Burch, Jr. ..... 248/442.2
6,099,094 A * 8/2000 Lior ..... 312/223.3
6,349,915 B1 * 2/2002 Jones et al. ..... 248/442.2
6,474,760 B2 * 11/2002 Rauls ..... 312/330.1
6,488,244 B2 * 12/2002 Ruan et al. ..... 248/118.1
6,672,558 B2 * 1/2004 Li ..... 248/463

* cited by examiner

*Primary Examiner*—Andrew H. Hirshfeld
*Assistant Examiner*—Dave A. Ghatt
(74) *Attorney, Agent, or Firm*—Birch, Stewart, Kolasch & Birch, LLP

(57) ABSTRACT

A keyboard with a paper holder structure, placed in a sliding mechanical structure below a computer tabletop, comprises a retaining area for accommodating the keyboard, and a paper holder installed on the retaining area for clipping papers above the retaining area to the working space and facilitate users to read the information from the paper at an appropriate distance in order to input the data into the computer accurately.

10 Claims, 4 Drawing Sheets

KEYBOARD WITH PAPER HOLDER STRUCTURE

FIELD OF INVENTION

The invention relates to a keyboard with a paper holder structure, more particularly to a keyboard with a paper holder structure on a tabletop for holding document or paper.

BACKGROUND OF THE INVENTION

A prior-art computer desk is generally small in size and has very limited using area for saving room. When a user input data, the user usually does not have sufficient room to put the written information required for inputting the data or turning the page of the document for reading. Therefore, such document is usually put on another chair or on the lap of the user. When the user needs to input data, the user has to draw the keyboard out from the keyboard tray below the computer desk. The keyboard tray will block the user's vision from reading the written information, and the user has to adjust his/her sitting pose for the typing and reading. After a long-time operation, it deteriorates the user's visual condition and makes the typing very tiresome. Furthermore, changing pose to input data generally causes the user to miss some information or fix up with the sequence. Such arrangement not only affects the quality of entering data, but also hurts the user's vision and sitting pose.

In view of these shortcomings, users tend to use a larger computer desk, so that the written information can be put on the desk or the user simply purchases a set of paper holder to clip the document on the desk. However, such larger computer desk does not fit in the place having little room such as school dormitories or small rooms. Therefore, some manufacturers have designed a set of paper holder attached onto the side of a computer monitor to effectively overcome the aforementioned shortcomings.

Although the computer paper holder can solve the problem and eliminate the inconvenience of the small tabletop of the traditional computer, it still has the following shortcomings in its practice:

1. Such paper holder is installed on the side of a computer monitor; when the user draws out the keyboard key to use the keyboard, there is a distance between the user and the computer monitor, and it is difficult for the user to accurately read the information from the paper next to the monitor, and thus the user usually ahs to lean forward for reading. Such arrangement not only affects the user's sitting pose, but also has negative effects on the user such as leaning too close to the computer monitor and being affected by the radiation.

2. If the user needs to write some notes or mark something in the document while entering the data, the user has to take the paper out from the holder, which wastes time and effort.

3. Since the paper is clipped onto the adjacent side of the computer monitor and its distance from the user is too far, therefore it usually causes the user to miss some information or fix up with the sequence of the document, and thus affects the quality of inputting data.

4. Installing a paper holder next to the computer monitor affects the artistic look of the design of the computer monitor.

SUMMARY OF THE INVENTION

The primary objective of the present invention is to overcome the above deficiencies and avoid the existing shortcomings by providing a paper holder installed on the keyboard, which is placed in a keyboard tray in accordance with the present invention to save the working space of the computer desk and facilitate users to read data from an appropriate distance.

The secondary objective of the present invention is to provide a simple structure to save time and effort for its installation, and greatly reduce the cost of buying another paper holder as the traditional arrangement needs.

To achieve the above objectives, the paper holder structure in accordance with the present invention installs a holder on a traditional movable keyboard tray of a computer desk for clipping the paper or written information for the input to save the working space on the tabletop of the computer desk and facilitate users to read data from the document at an appropriate distance, and input the data into the computer accurately.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
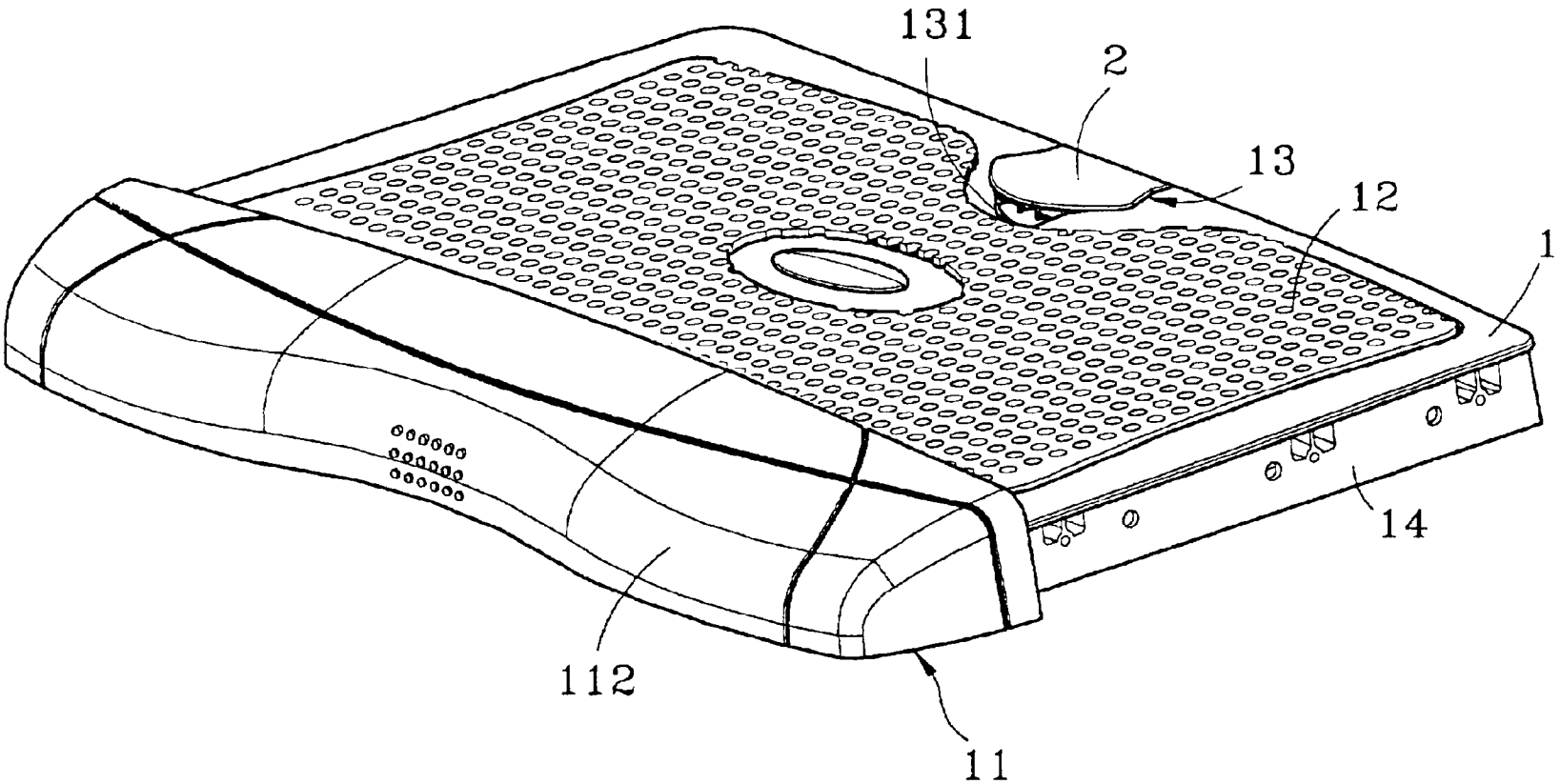
FIG. 1 is a perspective diagram of the present invention.
Figure 2:
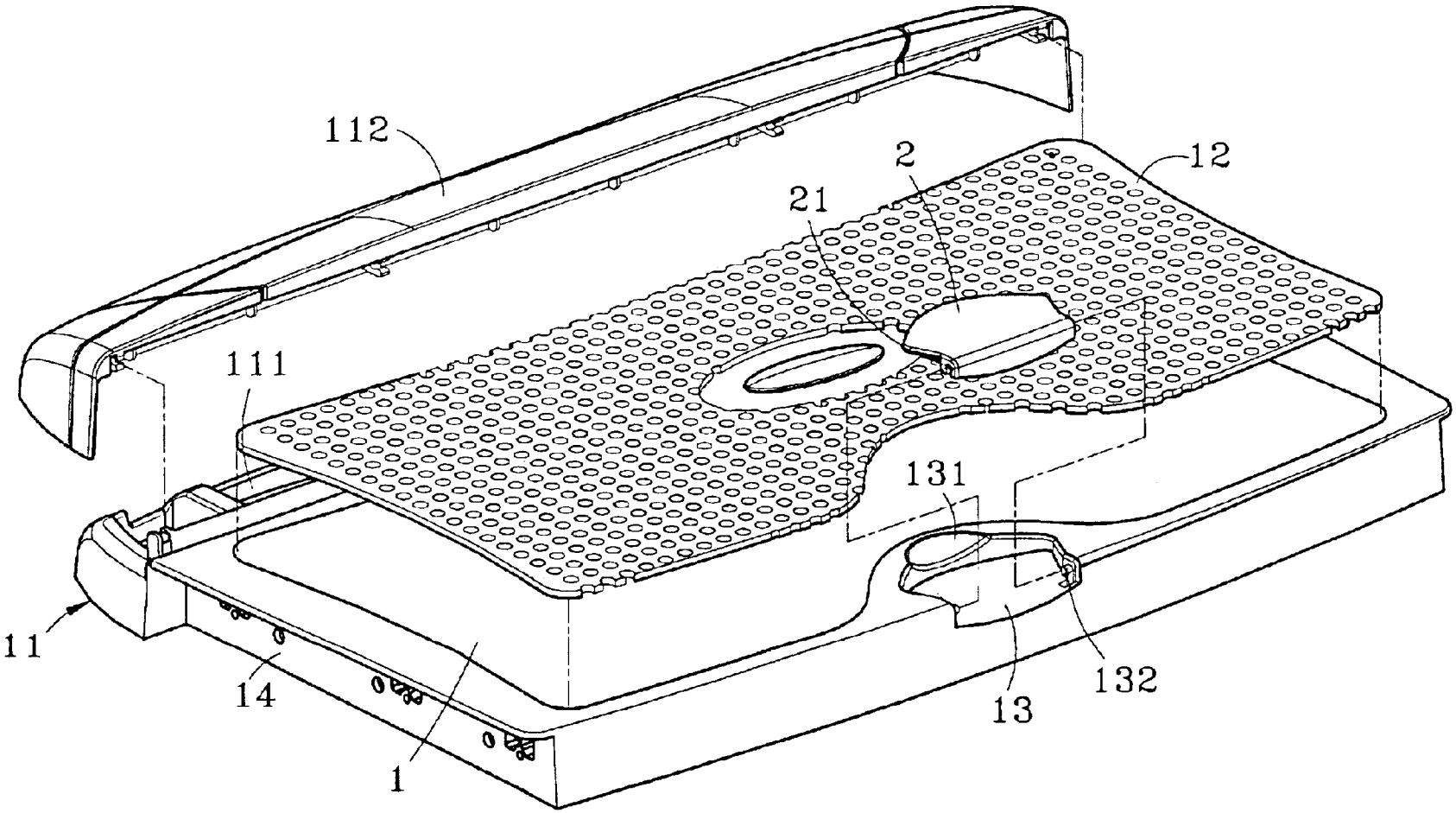
FIG. 2 is an illustrative diagram of the disassembled parts of the present invention.
Figure 3:
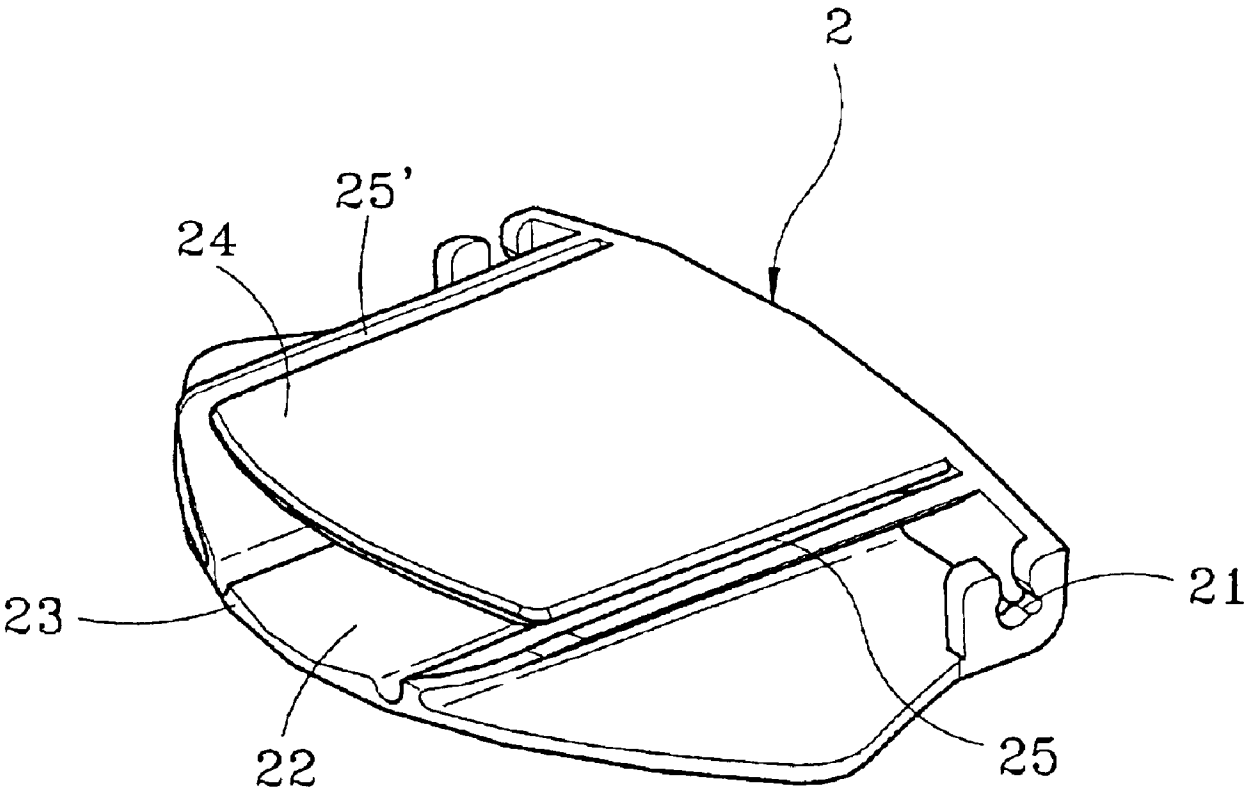
FIG. 3 is an illustrative diagram of a partially enlarged section of the present invention.

Refer to FIGS. 1, 2 and 3 for a perspective view, a view of disassembled parts, and a partially enlarged section of the present invention respectively. In the figures, the paper holder structure in accordance with the present invention comprises an assembly 14 installed at a sliding keyboard tray of a sliding mechanical structure below the top of the computer desk, such sliding mechanical structure comprises a retaining area 1 for accommodating the keyboard, and a holder 2 installed on the retaining area 1; a skid-proof pad 12 disposed on the retaining area 1; an ergonomic support section 11 protruded from an end of the retaining area 1; a glove compartment 111 disposed in the support section 11; a movable lid 112 pivotally coupled to the top of the glove compartment 111; a connecting groove 13 disposed on another end of the retaining area 1 corresponsive to the support section 11; an indention 131 disposed at the edge of the connecting groove 13; a connecting axle 132 for connecting the holder 2, each disposed on both sides of the connecting groove 13; a pivotal section 21, each disposed on both sides of the holder 2 corresponsive to the connecting axle 132 of the connecting groove 13, for pivotally coupling into the connecting axle 132 of the connecting axle 132 such that the holder 2 being capable of being pulled up and down freely; the holder is a two-plate one including a support member 23 and an elastic member 24, and an included section is defined between the elastic member 24 and the support member 23; a plurality of cut grooves 25, 25' disposed on both sides of the elastic member 24 and the support member 23 such that the user can pull the holder 2 from the interior of the connecting groove 13 upward and then clip a document or a piece of paper in the cut groove 25, 25' between the elastic member 24 and the support member 23. Such arrangement can effectively secure the written information required for the input, save working space of the tabletop of the computer desk, facilitate users to read data from the paper at a short distance, and enable users to input data into the computer accurately. When the user no longer uses the holder 2, the user can pull the holder 2 down to hide it in the connecting groove 13 for decoration and storage purposes.

Figure 4:
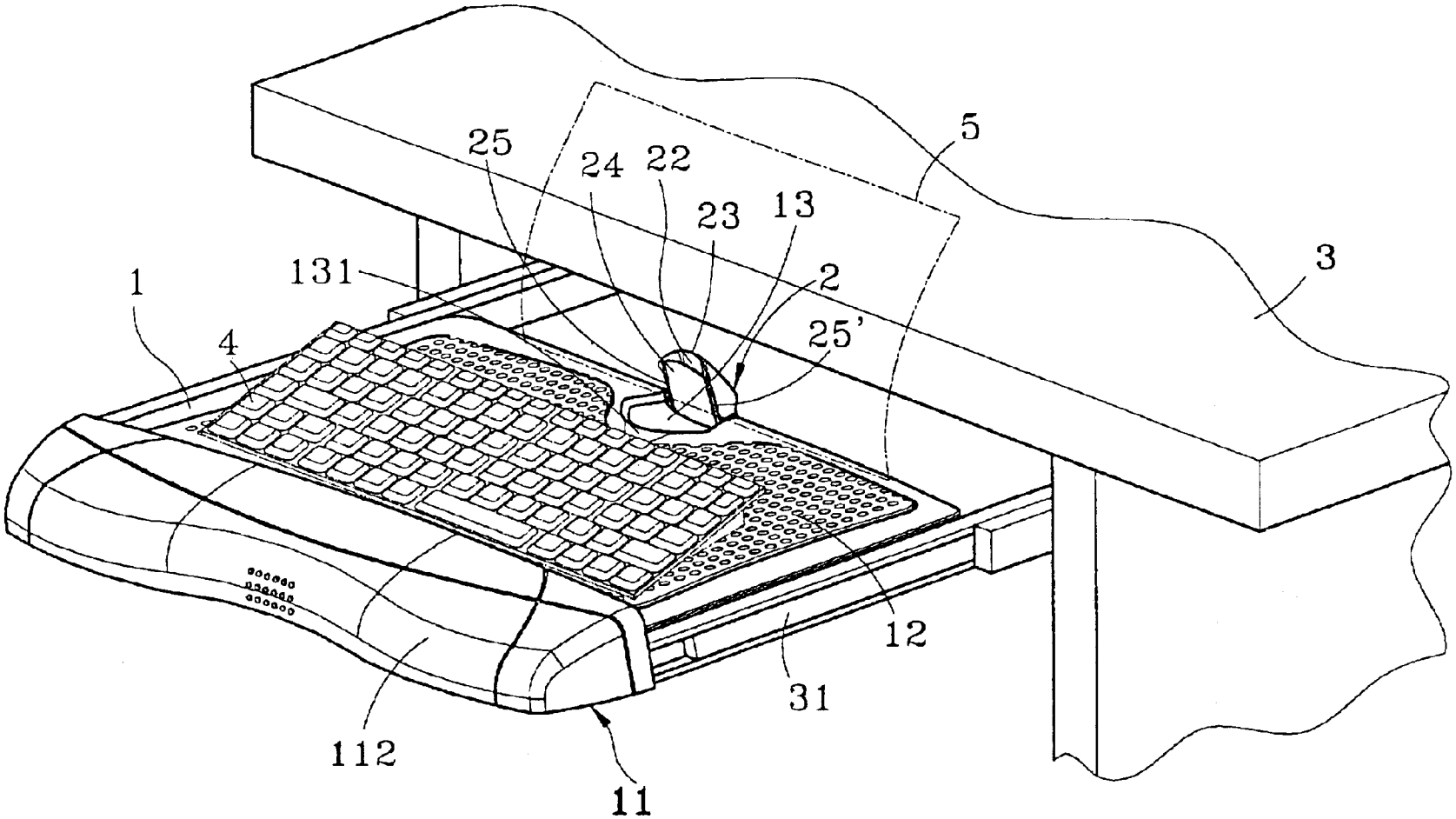
FIG. 4 is an illustrative diagram of the present invention when it is in use.

Please refer to FIG. 4 for an illustrative diagram of the present invention when it is in use. In the figure, the paper holder on the keyboard desktop in accordance with the present invention is installed onto a keyboard tray of a sliding mechanical structure 31 below the tabletop of a computer desk 3, and such structure comprises a retaining area 1 for accommodating a keyboard 4 and a holder 2 is installed above the retaining area 1; when the user needs to use the holder 2, the retaining area 1 for accommodating the keyboard 4 is pulled out by means of the sliding mechanical structure 3, and a force is applied on an indention 131 at the edge of the connecting groove 13 to pull the holder 2 upward, so that the holder 2 can be erected and fixed into a position. A force is applied to an elastic member 24 of the holder 2, so that a cut groove 25, 25' on each side of the elastic member 24 has enough room to let the document or paper be fixed into a clipping section 22. A piece of very soft paper 5 can lean against the edge of the tabletop 4 of the computer desk for further support. The paper 5 can be effectively fixed into the clipping section 22 of the holder 2, not just saving working area of the tabletop 4 of the computer desk, but also facilitating users to read the data on the paper 5 at an appropriate distance, and inputting the data into the computer accurately in order to avoid missing information or mixing up with the sequence of the document, which will affect the quality of inputting data. The present invention further avoids users from buying additional paper holder or installing extra paper holder on the tabletop of a computer desk or on the computer monitor, which saves the cost of the additional holder, and saves the time and effort for its installation.

Further, the prior-art keyboard 4 is placed on the retaining area 1 having a skid-proof pad 12; the friction of the skid-proof pad 12 can effectively prevent the keyboard from moving freely while the user is operating the keyboard 4. If the user forgets to pull the holder back into the connecting groove 1 before pushing the retaining area 1 of the keyboard tray back under the tabletop of the computer desk 4, the skid-proof pad can prevent the keyboard 4 from sliding or hitting the holder structure 2 due to the pushing force or damaging or loosening the holder structure 2.

Furthermore, since the holder 2 and the connecting groove 13 are pivotally coupled, therefore the holder 2 can be pulled inward or outward to facilitate the user to use and store the holder 2. Moreover, the indention 131 of the holder 2 enables the user to apply force to pull the holder 2 easily. After the holder 2 is pulled downward, the open end of the holder 2 and the retaining area are placed horizontally and engaged completely for its accommodation. Such design can keep the artistic look of the overall structure and also can serve as a decoration as well.

Further, an end of the retaining area 1 has an ergonomic support section 11, and a glove compartment 111 with a movable lid 112 pivotally coupled to the interior of the support section 11. Such arrangement not only lets users use the keyboard while resting their palms and wrists on the support section 11 comfortably, but also lets user put objects such as stationeries, watch, or calculator (not shown in the figure) in the glove compartment 111 for storage and use.

Those skilled in the art will readily recognize that these and various other modifications and changes may be made to the present invention without strictly following the exemplary application illustrated and described herein and without departing from the true spirit and scope of the present invention, which is set forth in the following claims.

What is claimed is:

1. A keyboard with paper holder structure, being installed to a keyboard tray of a sliding mechanical structure below the tabletop of a computer desk, said structure comprising:

a retaining area, for accommodating a keyboard; and a holder, installed above the retaining area;

so that the holder may clip a piece of paper on the retaining area to save the working space of the computer desk and facilitate users to read the data on the paper at an appropriate distance and input data into the computer accurately, wherein said holder is a two-plated holder including a support member and an elastic member, and wherein said elastic member has a cut groove on both sides.

2. The keyboard with paper holder structure of claim 1, wherein said retaining area comprising an ergonomic support section.

3. The keyboard with paper holder structure of claim 2, wherein said support section has a glove compartment.

4. The keyboard with paper holder structure of claim 3, wherein said glove compartment has movable lid pivotally coupled with the glove compartment.

5. The keyboard with paper holder structure of claim 1, wherein said retaining area has a skid-proof pad.

6. The keyboard with paper holder structure of claim 1, wherein said retaining area has a connecting groove.

7. The keyboard with paper holder structure of claim 6, wherein said connecting groove has a connecting axle on both sides of the connecting groove.

8. The keyboard with paper holder structure of claim 6, wherein said connecting groove at one of its sides has an indention.

9. The keyboard with paper holder structure of claim 1, wherein said holder at each of its both sides has a pivotal section coupled to a connecting axle on both sides of the connecting groove.

10. The keyboard with paper holder structure of claim 1, wherein said support member and elastic member define an including section between the support member and the elastic member.

* * * * *